US005586365A

United States Patent [19]

Leifeld et al.

[11] Patent Number: 5,586,365

[45] Date of Patent: Dec. 24, 1996

[54] FIBER TUFT FEEDER FOR A FIBER PROCESSING TEXTILE MACHINE

[75] Inventors: Ferdinand Leifeld, Kempen; Armin Leder, Mönchengladbach, both of Germany

[73] Assignee: Trützschler GmbH & Co. KG, Mönchengladbach, Germany

[21] Appl. No.: 532,855

[22] Filed: Sep. 22, 1995

[30] Foreign Application Priority Data

Sep. 24, 1994 [DE] Germany ..... 44 34 251.9

[51] Int. Cl.[6] ..... D01G 15/40; D01G 23/02; D01G 15/74

[52] U.S. Cl. ..... 19/105; 19/296

[58] Field of Search ..... 19/105, 296, 97.5, 19/302, 303, 304, 305

[56] References Cited

U.S. PATENT DOCUMENTS

| | | | |
|---|---|---|---|
| 4,811,463 | 3/1989 | Leifeld | 19/105 |
| 5,083,345 | 1/1992 | Leifeld | 19/296 X |
| 5,197,162 | 3/1993 | Pinto et al. | 19/105 |
| 5,303,455 | 4/1994 | Leifeld | 19/105 X |
| 5,442,836 | 8/1995 | Fehrer | 19/296 X |

FOREIGN PATENT DOCUMENTS

| | | |
|---|---|---|
| 3239524 | 7/1983 | Germany . |
| 3912565 | 10/1990 | Germany . |
| 1432102 | 10/1988 | U.S.S.R. . |

*Primary Examiner*—John J. Calvert
*Attorney, Agent, or Firm*—Spencer & Frank

[57] ABSTRACT

A fiber tuft feeder includes a first chute; a feed roller supported at the outlet end of the first chute; an opening roller adjoining the feed roller and being supported below the feed roller and receiving fiber tufts therefrom; a second chute extending downwardly from the opening roller; a densifying air stream generating arrangement for introducing an air stream into the second chute to densify the fiber tufts therein; and a guide arrangement for directing the densifying air stream to flow consecutively along the feed roller and the opening roller.

20 Claims, 5 Drawing Sheets

FIG. 2a
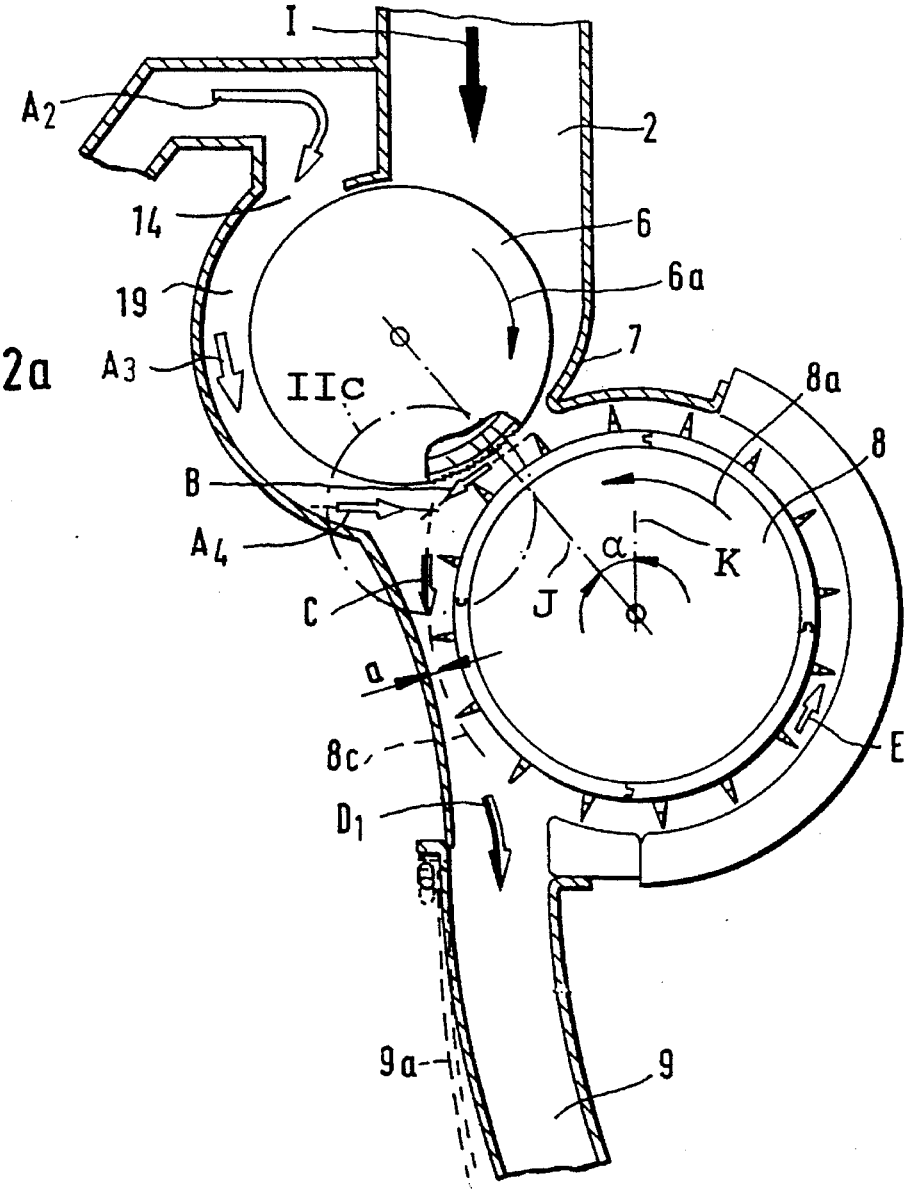
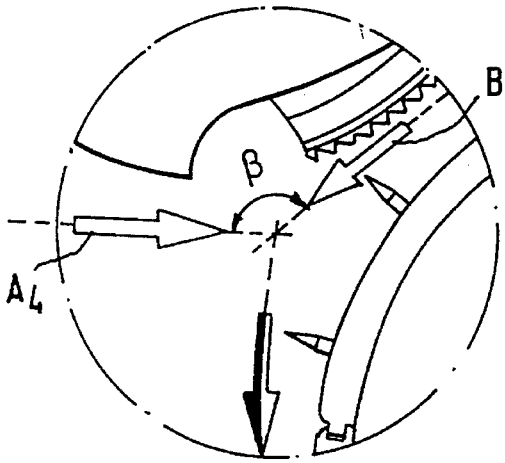
FIG. 2c

FIBER TUFT FEEDER FOR A FIBER PROCESSING TEXTILE MACHINE

CROSS REFERENCE TO RELATED APPLICATION

This application claims the priority of German Application No. P 44 34 251.9 filed Sep. 24, 1994, which is incorporated herein by reference.

BACKGROUND OF THE INVENTION

This invention relates to a fiber tuft feeder for supplying a textile fiber lap to a fiber processing machine such as a carding machine, a roller card unit or the like. The feeder is of the type which has a vertical first chute (upper or reserve chute), at the lower opening of which a feed roller is disposed, cooperating with an opening roller situated therebelow. From the opening roller, approximately tangentially thereto, a second chute (lower or feed chute) extends which is associated with a device which provides a densifying (fiber-compressing) air stream that passes through the fiber material situated in the feed chute. Such a fiber-compressing air stream flows along the opening roller, codirectionally with its direction of rotation.

According to a known apparatus, as disclosed in German Offenlegungsschrift (application published without examination) 39 12 565, an air outlet duct is provided for guiding a transporting air stream out of the upper chute after such transporting air stream deposited fiber tufts into the upper chute through an upper inlet thereof. In the air outlet duct a fan is disposed which branches off a partial air stream of the transporting air stream. Such a partial air stream proceeds along the cylindrical surface of the opening roller and subsequently flows tangentially to the opening roller to the clearance defined between the feed roller and the opening roller. During this occurrence, the air stream emanating from the fan and accelerated along the opening roller impinges upon the clearance and is abruptly braked thereby, causing a significant air turbulence. Such an undesired vortex generation is further amplified by the fact that the air stream generated by the fan is pulsating, that is, such an air stream is not uniform. Furthermore, the transporting air stream supplied to the fan is also fluctuating because of the fluctuating supply of fiber tufts in the upper chute. It is further disadvantage of the known arrangement that the air stream is significantly weakened by the clearance between the feed roller and the opening roller and thus its densifying (compressing) effect is adversely affected.

SUMMARY OF THE INVENTION

It is an object of the invention to provide an improved apparatus of the above-outlined type from which the discussed disadvantages are eliminated and which, in particular, improves the flow of the densifying air stream and makes possible an improved guidance of the fiber material in the lower chute.

This object and others to become apparent as the specification progresses, are accomplished by the invention, according to which, briefly stated, the fiber tuft feeder includes a first chute; a feed roller supported at the outlet end of the first chute; an opening roller adjoining the feed roller and being supported below the feed roller and receiving fiber tufts therefrom; a second chute extending downwardly from the opening roller; a densifying air stream generating arrangement for introducing an air stream into the second chute to densify the fiber tufts therein; and a guide arrangement for directing the densifying air stream to flow consecutively along the feed roller and the opening roller.

Thus, according to the invention, the densifying (compressing) air stream first flows along the feed roller. Thereafter, the opening roller entrains the densifying air stream and deflects it into the direction of the lower chute, thus circumventing the clearance between the feed roller and the opening roller. In this manner, the flow behavior of the densifying air stream is improved and a better guidance of the fiber material and the air stream is feasible in the lower chute. Also, in contrast to conventional arrangements, the densifying air stream is not decelerated. By virtue of the fact that the densifying air stream flows around the feed roller, fiber tufts adhering to the feed roller which have not been stripped by the opening roller are advantageously blown off.

The invention has the following additional advantageous features:

- The densifying air stream is continuous, particularly as a result of using a fan.
- The feed roller and the opening roller rotate in mutually opposite directions.
- The densifying air current is directed codirectionally with the direction of rotation of the feed roller.
- The densifying current essentially flows along the circumferential surface of the feed roller.
- The densifying current flows along the clearance between the feed roller and the opening roller at that side towards which the fiber tufts are thrown by the opening roll.
- The densifying air stream and the air stream generated by the rotation of the opening roller form a rectangle or an obtuse angle with one another.
- One of the large walls of the lower chute has a preferably planar or curved extension which faces the feed roller.
- The extension, the side walls belonging thereto and the feed roller form a channel.
- The extension faces the opening roller and bounds the channel.
- Upstream of the channel a wide-slotted nozzle is provided for the densifying air stream.
- The channel extends from the outlet of the nozzle to the zone of the opening roller at which the fiber tufts are thrown by the opening roller.
- The distances of the circumferential surfaces of the feed roller and the opening roller from the extension are approximately identical.
- The distances of the circumferential surfaces of the feed roller and the opening roller from the extension have a ratio of approximately 1:2.
- The channel is straight in a zone facing the opening roller and is curved in a zone facing the feed roller.
- The channel-like chamber is of concave curvature in a zone facing the opening roller.
- The channel-like chamber has a constriction in the zone of the opening roller.
- The cross section of the constriction in the channel is approximately 50 to 70% that of the cross-sectional area in the zone of the feed roller.
- The feed roller and a counterface formed by the adjoining wall portion of the upper chute form a channel-like space.
- In the region of the clearance between the feed roller and the opening roller the densifying air stream and the air stream generated by the rotation of the opening roller are oriented at an obtuse angle to one another.

The wide-slotted nozzle and the upper chute have a common wall surface.

BRIEF DESCRIPTION OF THE DRAWINGS

FIG. 2*a* is an enlarged schematic sectional side elevational view of a detail of FIG. 1.

FIG. 2*c* is an enlarged detail of inset IIc in FIG. 2*a*.

DESCRIPTION OF THE PREFERRED EMBODIMENTS

Figure 1:
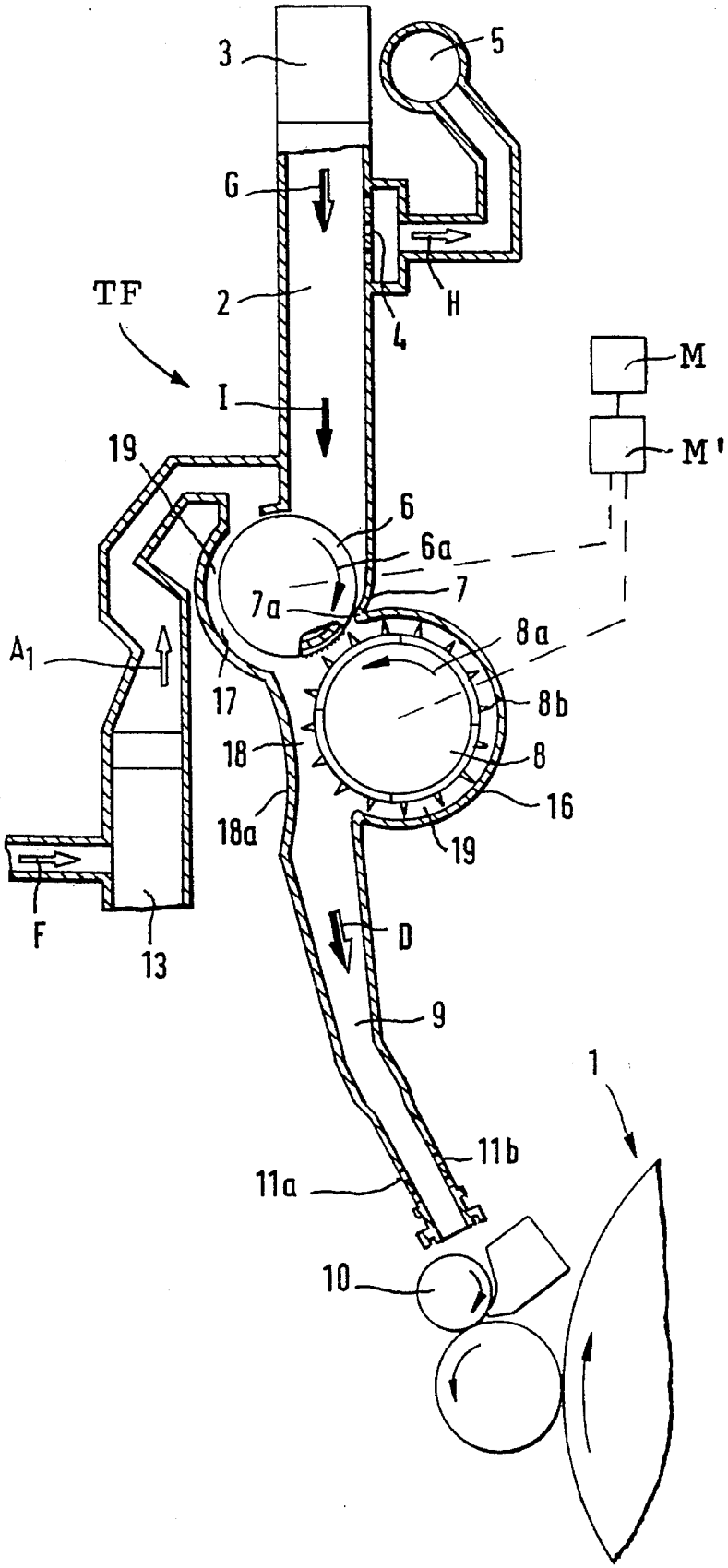
FIG. 1 is a schematic sectional side elevational view of a preferred embodiment of the invention.

Turning to FIG. 1, a tuft feeder generally designated at TF is arranged at the input side of a carding machine 1. The tuft feeder TF has a vertical reserve chute (upper chute) 2 which is charged through an upper chute inlet with finely opened fiber material. Such charging operation may be performed, for example, by means of a condenser, via a supply-and-distributing duct 3. In the upper zone of the reserve chute 2, air outlet openings 4 are provided through which the transporting air stream G may pass into a suction device 5 in the direction of the arrow H after the fiber tufts have been separated from the transporting air stream. The lower end of the reserve chute 2 is obturated by a feed roller 6 which cooperates with a feed tray 7. The feed roller 6 advances the fiber material I into an underlying adjacent, rapidly rotating opening roller 8 which is provided with pins 8*b* or a sawtooth clothing and which, along a path of its circumference, faces a feed chute (lower chute) 9. A phantom-line circle 8*c* in FIG. 3 indicates the periphery of the opening roller 8 as defined by the points of pins 8*b*. The opening roller 8 which is rotated in the direction of the arrow 8*a* delivers the fiber material caught thereby into the feed chute 9. The feed chute 9 has at its lower end a delivery roller 10 which advances the fiber material (fiber lap) from the feed chute 9 to the carding machine 1. The feeder with features as outlined above, may be, for example, an EXACTAFEED FBK model, manufactured by Trützschler GmbH & Co. KG, Mönchengladbach, Germany. A motor M, associated with appropriate gearing M', rotates the feed roller 6 slowly in the direction of the arrow 6*a* while it rotates the opening roller 8 rapidly in the opposite rotary direction 8*a*.

The lower wall portion of the feed chute 9 is provided with air outlet openings 11*a*, 11*b*. Also referring to FIG. 3, the feed chute 9 communicates at its top with a chamber 12 with the intermediary of a channel 12*a*. The chamber 12 is connected at one end with the pressure side of a fan 13.

The rotating feed roller 6 and the rotating opening roller 8 continuously supply a certain amount of fiber material into the feed chute 9 and the same amount of fiber material is withdrawn from the feed chute 9 by the delivery roller 10 and advanced to the carding machine 1. In order to ensure that such quantities are uniformly condensed and maintained constant, a densifying air stream is driven by the fan 13 through the chamber 12 and a constriction (wide-slot nozzle) 14 downstream of the chamber 12. In the feed chute 9 the fiber material is exposed to the densifying air stream. The fan 13 draws air from the air outlet channel 15*a* communicating with the air outlet openings 11*a*, 11*b* and drives the air into the fiber mass present in the feed chute 9. Thereafter the air exits through the air outlet openings 11*a*, 11*b* at the lower end of the feed chute 9 into the air outlet channel 15*a* as illustrated by the arrow F. The opening roller 8 and the feed roller 6 are partially circumferentially surrounded by a wall face of respective housings 16 and 17. These wall faces conform to the circular configuration of the rollers 6 and 8. As viewed in the direction of rotation 8*a* of the opening roller 8, the housing 16 is interrupted by a separating opening 18 for the fiber material. The separating opening 18 is joined by a channel 19 bounded by the housing 16 and the circumferential surface of the opening roller 8. The channel 19 extends to the feed roller 6. The feed tray 7 is arranged at the lower end of the wall region facing the feed roller 6. The edge 7*a* of the feed tray 7 is oriented in the rotary direction 8*a* of the opening roller 8.

Referring particularly to FIG. 2*a*, The plane J which contains the rotary axes of the feed roller 6 and the opening roller 8 is inclined under an angle $\alpha$ of between about 30° to 90° (for example, 35°) with respect to the vertical plane K containing the rotary axis of the opening roller 8, in the direction of rotation of the opening roller 8. Stated differently, the plane J divides the opening roller 8 into a first and a second side. By virtue of the direction of rotation of the opening roller 8, the fiber tufts are thrown thereby into the first side. The plane J is inclined relative to the plane K towards the first side. The channels 18 and 19 and the feed chute 9 are in communication with one another. The wall face 9*a* of the feed chute 9 may be adjusted in the width direction as illustrated in FIG. 2*a*.

Figure 2B:
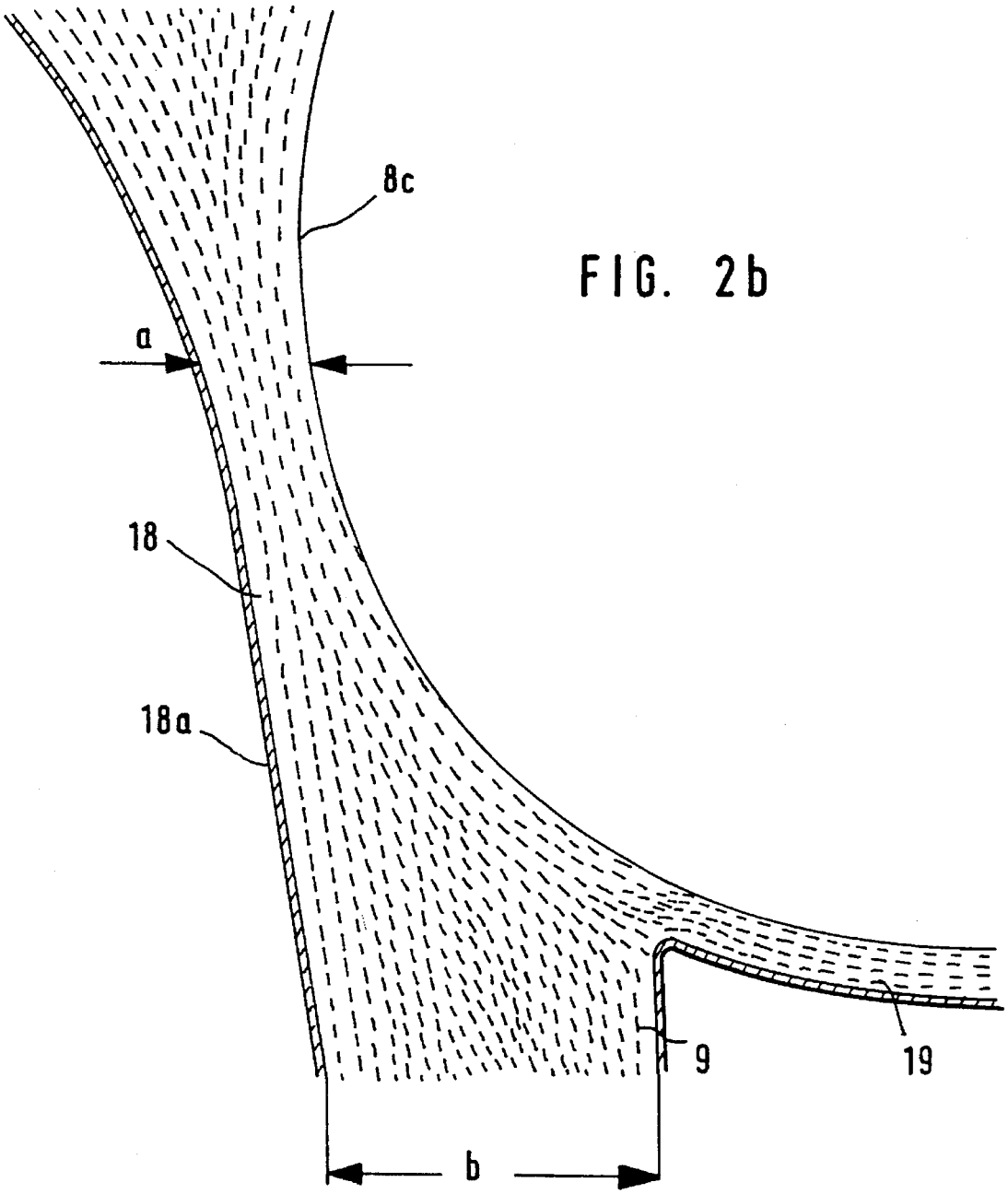
FIG. 2*b* is a schematic sectional side elevational view of a part of FIG. 2*a* showing flow behavior.
Figure 3:
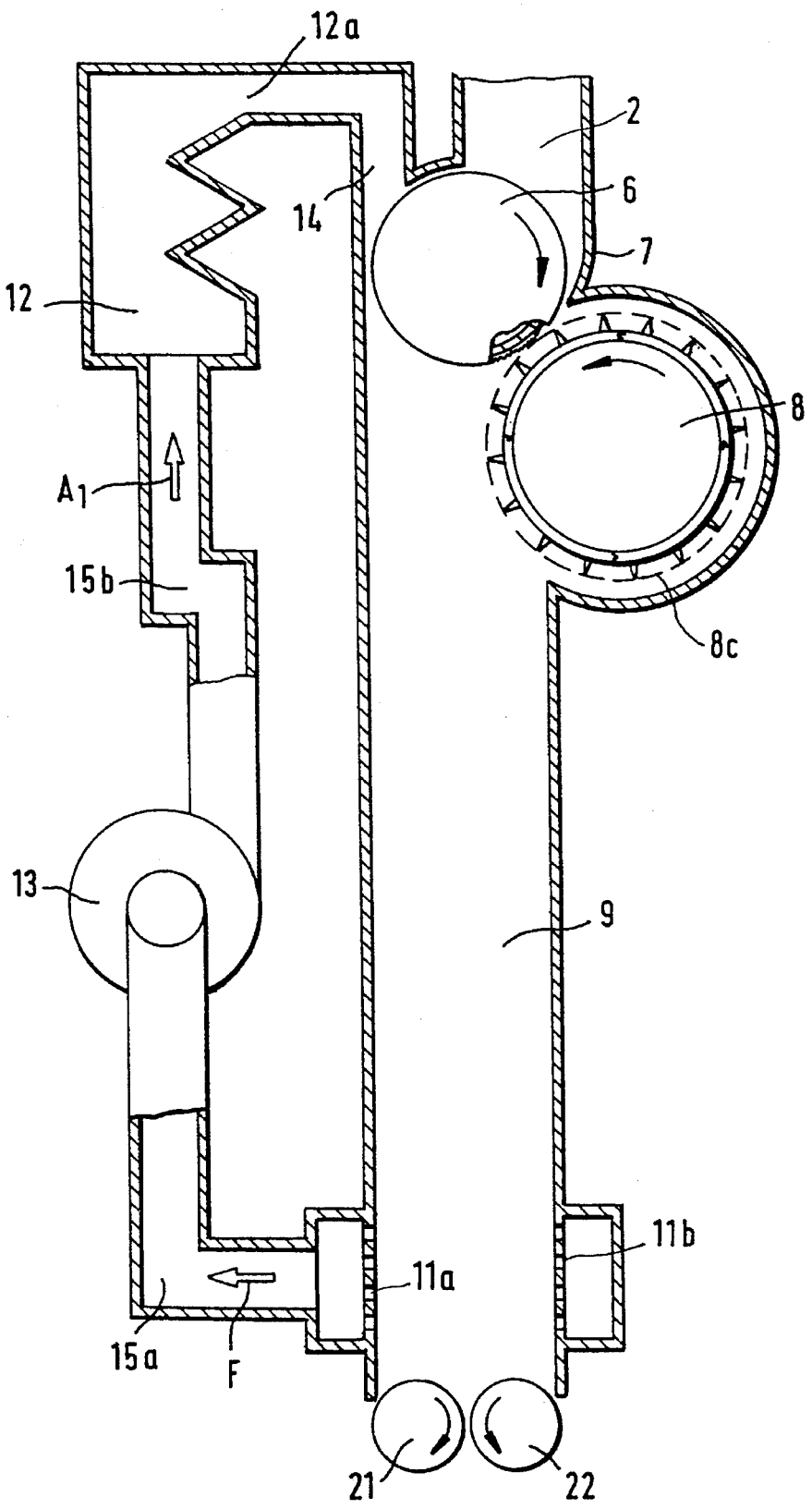
FIG. 3 is a schematic sectional side elevational view of a variant of the preferred embodiment.

Particularly referring to FIGS. 2*a* and 3, the densifying air stream exits from the pressure side of the fan 13, passes through the conduit 15*b* and the chamber 12 as indicated by arrow $A_1$, and enters the wide-slotted nozzle 14, as indicated by the arrow $A_2$. Thereafter, the densifying air stream proceeds, as indicated by the arrow $A_3$ through the chamber 19 at that side of the feed roller 6 and the opening roller 8 at which the feed chute 9 begins. First the air stream flows along a significant circumferential part of the feed roller 6 and thereafter along the opening roller 8. During this occurrence, the densifying air current flows against the rotary direction 6*a* of the feed roller 6 and thus blows back fiber tufts still adhering to the feed roller 6.

The rapidly rotating opening roller 18, as also illustrated in FIG. 2*c*, entrains an air stream B. The densifying air stream, as shown at $A_4$, flows in the direction of the opening roller 8 and merges with the air stream B under an angle $\beta$ which is at least 90° ($\beta$ is shown to be obtuse in FIG. 2*c*). Thereafter, the air streams $A_4$ and B are combined into an air stream C which flows in the rotary direction 8*a* of the opening roller 8 in the chamber 18 and passes through a constriction a provided in the chamber 18. During this occurrence, as shown in FIG. 2*b*, the combined air stream C is aligned and oriented in the direction of the upper opening of the feed chute 9 and flows from the opening roller 8 slightly deflected into the feed chute 9 as an air stream $D_1$. At the same time, the air stream $D_1$ entrains fiber tufts thrown by the opening roller 8. By virtue of the fact that the channel 18 widens in the direction of the feed chute 9 by a curving of the wall faces 18*a* from distance a to distance b, the fiber tuft-laden air stream $D_1$ may expand downstream of the opening roller 8 and is thus not entrained by the opening roller 8 into a circumferential path but it enters the chamber 19 only as a branched, lesser residual air stream E.

The opening roller 8 supplies fiber tufts into the air streams C and $D_1$. The channel 18 extends essentially along a lateral zone of the opening roller 8 so that the air streams $A_4$, C and $D_1$ in the feed chute 9, serving for densifying the fiber material are effective along the opening roller 8. The separation of the fiber tufts from the needles 8*b* of the opening roller 8 effected by centrifugal forces may be, for example, pneumatically supported.

Figure 4:
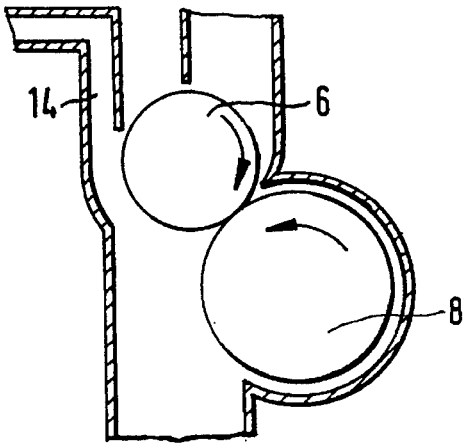
FIGS. 4, 5 and 6 are schematic side elevational sectional details of the general construction of FIG. 1 showing three variants.
Figure 5:
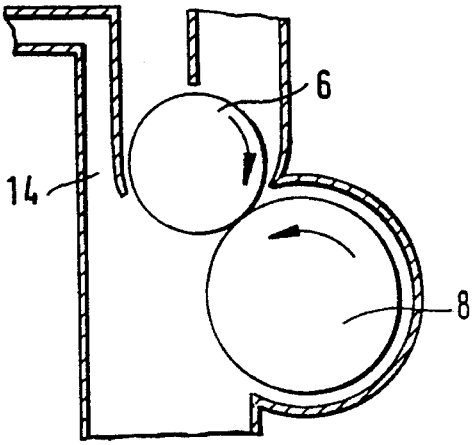
Figure 6:
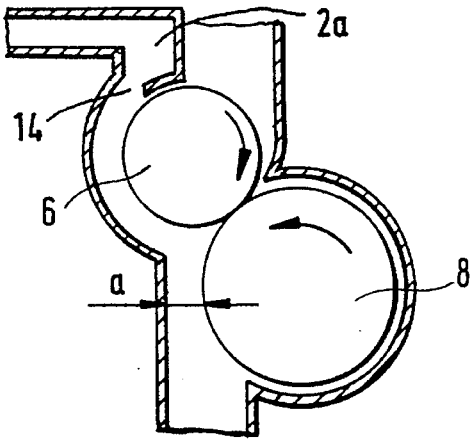

As shown in FIG. 4, the outlet of the wide-slotted nozzle 14 faces the circumferential face of the feed roller 6 above the horizontal diameter of the feed roller 6. According to FIG. 5, the nozzle 14 opens underneath the horizontal diameter of the feed roller 6 such that the circumferential surface of the feed roller 6 is essentially screened. As shown in FIG. 6, the wide-slotted nozzle 14 and the upper chute 2 have a common wall 2*a*, that is, the sheet metal chute wall has a dual use.

It will be understood that the above description of the present invention is susceptible to various modifications, changes and adaptations, and the same are intended to be comprehended within the meaning and range of equivalents of the appended claims.

What is claimed is:

1. A fiber tuft feeder comprising (a) a first chute having an upper, inlet end and a lower, outlet end;

(b) charging means for introducing fiber tufts into said first chute through said inlet end;

(c) a feed roller supported at said outlet end of said first chute; said feed roller having a rotary axis;

(d) an opening roller adjoining said feed roller and being supported below said feed roller; said opening roller having a rotary axis; said opening roller receiving fiber tufts from said feed roller; an imaginary plane containing said rotary axes dividing said feed roller and said opening roller into first and second sides; said opening roller throwing fiber tufts to said first side;

(e) drive means for rotating said feed roller and said opening roller;

(f) a second chute extending downwardly from said opening roller at said first side of said feed roller and said opening roller; said second chute having an upper, initial portion extending generally tangentially to said opening roller;

(g) densifying air stream generating means for introducing an air stream into said second chute to densify the fiber tufts therein; and (h) guide means for directing said densifying air stream to flow consecutively along said feed roller and said opening roller on said first side; said guide means including means for directing said densifying air stream circumferentially about a significant part of a surface of said feed roller.

2. The fiber tuft feeder as defined in claim 1, wherein said second chute has a wall provided with an extension facing said opening roller; said extension forming part of said guide means.

3. The fiber tuft feeder as defined in claim 2, wherein said extension is planar.

4. The fiber tuft feeder as defined in claim 2, wherein said extension is curved.

5. The fiber tuft feeder as defined in claim 4, wherein said extension is concave with respect to said opening roller.

6. The fiber tuft feeder as defined in claim 2, further comprising means defining a channel leading into said second chute; said channel forming part of said guide means; said means defining said channel including said extension and said opening roller.

7. The fiber tuft feeder as defined in claim 6, wherein said channel extends from said feed roller.

8. The fiber tuft feeder as defined in claim 6, wherein said guide means further comprises a nozzle situated upstream of said channel as viewed in a direction of flow of the densifying air stream; said nozzle adjoining said feed roller.

9. The fiber tuft feeder as defined in claim 8, wherein said nozzle and said first chute have a common wall.

10. The fiber tuft feeder as defined in claim 1, wherein said feed roller and said opening roller together define an air gap through which an additional air stream generated by the rotation of said opening roller passes; said guide means including means for orienting said densifying air stream toward said additional air stream such that said densifying air stream meets said additional air stream at an angle being at least 90°.

11. The fiber tuft feeder as defined in claim 10, wherein said angle is obtuse.

12. The fiber tuft feeder as defined in claim 1, wherein said drive means includes means for rotating said feed roller and said opening roller in opposite directions.

13. A fiber tuft feeder comprising (a) a first chute having an upper, inlet end and a lower, outlet end;

(b) charging means for introducing fiber tufts into said first chute through said inlet end;

(c) a feed roller supported at said outlet end of said first chute; said feed roller having a rotary axis and a circumferential surface;

(d) an opening roller adjoining said feed roller and being supported below said feed roller; said opening roller having a rotary axis and a circumferential surface; said opening roller receiving fiber tufts from said feed roller; an imaginary plane containing said rotary axes dividing said feed roller and said opening roller into first and second sides; said opening roller throwing fiber tufts to said first side;

(e) drive means for rotating said feed roller and said opening roller;

(f) a second chute extending downwardly from said opening roller at said first side of said feed roller and said opening roller; said second chute having an upper, initial portion extending generally tangentially to said opening roller; a said second chute having a wall provided with an extension having a first length portion facing said feed roller and a second length portion facing said opening roller; a ratio of a distance of said circumferential surface of said feed roller from said first length portion approximately equalling a distance of said circumferential surface of said opening roller from said second length portion;

(g) densifying air stream generating means for introducing an air stream into said second chute to densify the fiber tufts therein; and (h) guide means for directing said densifying air stream to flow consecutively along said feed roller and said opening roller on said first side; said extension forming part of said guide means.

14. A fiber tuft feeder comprising (a) a first chute having an upper, inlet end and a lower, outlet end;

(b) charging means for introducing fiber tufts into said first chute through said inlet end;

(c) a feed roller supported at said outlet end of said first chute; said feed roller having a rotary axis and a circumferential surface;

(d) an opening roller adjoining said feed roller and being supported below said feed roller; said opening roller having a rotary axis and a circumferential surface; said opening roller receiving fiber tufts from said feed roller; an imaginary plane containing said rotary axes dividing said feed roller and said opening roller into first and second sides; said opening roller throwing fiber tufts to said first side;

(e) drive means for rotating said feed roller and said opening roller;

(f) a second chute extending downwardly from said opening roller at said first side of said feed roller and said opening roller; said second chute having an upper, initial portion extending generally tangentially to said opening roller; said second chute having a wall provided with an extension having a first length portion facing said feed roller and a second length portion facing said opening roller; a ratio of a distance of said circumferential surface of said feed roller from said first length portion to a distance of said circumferential surface of said opening roller from said second length portion being approximately 1:2;

(g) densifying air stream generating means for introducing an air stream into said second chute to densify the fiber tufts therein; and (h) guide means for directing said densifying air stream to flow consecutively along said feed roller and said opening roller on said first side; said extension forming part of said guide means.

15. A fiber tuft feeder comprising (a) a first chute having an upper, inlet end and a lower, outlet end;

(b) charging means for introducing fiber tufts into said first chute through said inlet end;

(c) a feed roller supported at said outlet end of said first chute; said feed roller having a rotary axis;

(d) an opening roller adjoining said feed roller and being supported below said feed roller; said opening roller having a rotary axis; said opening roller receiving fiber tufts from said feed roller; an imaginary plane containing said rotary axes dividing said feed roller and said opening roller into first and second sides; said opening roller throwing fiber tufts to said first side;

(e) drive means for rotating said feed roller and said opening roller;

(f) a second chute extending downwardly from said opening roller at said first side of said feed roller and said opening roller; said second chute having an upper, initial portion extending generally tangentially to said opening roller; said second chute having a wall provided with an extension having a first length portion facing said feed roller and a second length portion facing said opening roller;

(g) densifying air stream generating means for introducing an air stream into said second chute to densify the fiber tufts therein;

(h) guide means for directing said densifying air stream to flow consecutively along said feed roller and said opening roller on said first side; said extension forming part of said guide means; and (i) means defining a channel leading into said second chute; said channel forming part of said guide means; said means defining said channel including said extension, said feed roller and said opening roller; said channel having a constriction defined between said extension and said opening roller.

16. The fiber tuft feeder as defined in claim 15, wherein said constriction has a cross-sectional area which is approximately 50% to 70% smaller than a cross-sectional area of said channel in a region of said feed roller.

17. A fiber tuft feeder comprising (a) a first chute having an upper, inlet end and a lower, outlet end;

(b) charging means for introducing fiber tufts into said first chute through said inlet end;

(c) a feed roller supported at said outlet end of said first chute; said feed roller having a rotary axis;

(d) an opening roller adjoining said feed roller and being supported below said feed roller; said opening roller having a rotary axis; said opening roller receiving fiber tufts from said feed roller; an imaginary plane containing said rotary axes dividing said feed roller and said opening roller into first and second sides; said opening roller throwing fiber tufts to said first side;

(e) drive means for rotating said feed roller and said opening roller;

(f) a second chute extending downwardly from said opening roller at said first side of said feed roller and said opening roller; said second chute having an upper, initial portion extending generally tangentially to said opening roller; said second chute having a wall provided with an extension having a first length portion facing said feed roller and a second length portion facing said opening roller; said first length portion of said extension being curved and said second length portion of said extension being planar;

(g) densifying air stream generating means for introducing an air stream into said second chute to densify the fiber tufts therein; and (h) guide means for directing said densifying air stream to flow consecutively along said feed roller and said opening roller on said first side; said extension forming part of said guide means.

18. A fiber tuft feeder comprising (a) a first chute having an upper, inlet end and a lower, outlet end;

(b) charging means for introducing fiber tufts into said first chute through said inlet end;

(c) a feed roller supported at said outlet end of said first chute; said feed roller having a rotary axis;

(d) an opening roller adjoining said feed roller and being supported below said feed roller; said opening roller having a rotary axis; said opening roller receiving fiber tufts from said feed roller; an imaginary plane containing said rotary axes dividing said feed roller and said opening roller into first and second sides; said opening roller throwing fiber tufts to said first side;

(e) drive means for rotating said feed roller and said opening roller;

(f) a second chute extending downwardly from said opening roller at said first side of said feed roller and said opening roller; said second chute having an upper, initial portion extending generally tangentially to said opening roller; said second chute having a wall provided with an extension facing said opening roller;

(g) densifying air stream generating means for introducing an air stream into said second chute to densify the fiber tufts therein;

(h) guide means for directing said densifying air stream to flow consecutively along said feed roller and said opening roller on said first side; said extension forming part of said guide means; and (i) means defining a channel leading into said second chute and extending from said feed roller; said channel forming part of said guide means; said means defining said channel including said extension and said opening roller.

19. A fiber tuft feeder comprising (a) a first chute having an upper, inlet end and a lower, outlet end;

(b) charging means for introducing fiber tufts into said first chute through said inlet end;

(c) a feed roller supported at said outlet end of said first chute; said feed roller having a rotary axis;

(d) an opening roller adjoining said feed roller and being supported below said feed roller; said opening roller having a rotary axis; said opening roller receiving fiber tufts from said feed roller; an imaginary plane containing said rotary axes dividing said feed roller and said opening roller into first and second sides; said opening roller throwing fiber tufts to said first side;

(e) drive means for rotating said feed roller and said opening roller;

(f) a second chute extending downwardly from said opening roller at said first side of said feed roller and said opening roller; said second chute having an upper, initial portion extending generally tangentially to said opening roller;

(g) densifying air stream generating means for introducing an air stream into said second chute to densify the fiber tufts therein; and (h) guide means for directing said densifying air stream to flow consecutively along said feed roller and said opening roller on said first side; said guide means including a curved channel for directing said densifying air stream circumferentially about a part of a surface of said feed roller; said curved channel having first and second face-to-face located, curved, channel-defining surfaces.

20. The fiber tuft feeder as defined in claim 11, further comprising a housing; said first channel-defining surface being formed by an inner face of a portion of said housing and said second channel-defining surface being formed by a circumferential portion of said feed roller.

* * * * *